US006387184B1

(12) United States Patent
Gibson et al.

(10) Patent No.: US 6,387,184 B1
(45) **Date of Patent: *May 14, 2002**

(54) SYSTEM AND METHOD FOR INTERCHANGEABLY INTERFACING WET COMPONENTS WITH A COATING APPARATUS

(75) Inventors: Gregory M. Gibson, Dallas; Carl W. Newquist, Plano; John E. Hawes, Grapevine; Altaf A. Poonawala, Flower Mound; Scott A. Snodgrass, Garland; Samer Mahmoud Kabbani, Dallas, all of TX (US)

(73) Assignee: FAStar, Ltd., Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/226,983

(22) Filed: Jan. 8, 1999

Related U.S. Application Data

(60) Provisional application No. 60/070,985, filed on Jan. 9, 1998.

(51) Int. Cl.[7] ..... B05B 3/00; B05B 15/06; B05B 9/03; B05D 5/12

(52) U.S. Cl. ..... 118/323; 118/301; 118/302; 427/445; 347/84; 239/172; 239/175; 239/305; 239/390

(58) Field of Search ..... 347/84, 28, 43; 134/169, 104.1, 123; 118/323, 301; 427/445; 239/172, 175, 305, 390

(56) References Cited

U.S. PATENT DOCUMENTS

| | | | | | |
|---|---|---|---|---|---|
| 2,281,169 | A | * | 4/1942 | Pattison | 118/320 X |
| 3,968,498 | A | * | 7/1976 | Uchiyand | 118/663 X |
| 4,059,123 | A | * | 11/1977 | Bartos et al. | 134/102 |
| 4,196,020 | A | * | 4/1980 | Hornak et al. | 134/169 X |
| 4,213,474 | A | * | 7/1980 | Harrison | 134/169 A |
| 4,629,164 | A | * | 12/1986 | Sommerville | 239/69 |
| 4,979,380 | A | * | 12/1990 | Robbins et al. | 118/323 X |
| 5,029,755 | A | * | 7/1991 | Schmidt et al. | 239/1 |
| 5,348,585 | A | * | 9/1994 | Weston | 118/323 X |
| 5,853,068 | A | * | 12/1998 | Dixon et al. | 134/169 A |

* cited by examiner

*Primary Examiner*—Richard Crispino
*Assistant Examiner*—J. A. Lorengo
(74) *Attorney, Agent, or Firm*—Winstead Sechrest & Minick, P.C.

(57) ABSTRACT

A system and method for modularly interfacing wet components of a coating apparatus to the remainder of the coating apparatus comprising a station whereupon a substrate is located. A fluid cart houses the wet components of the apparatus which comprise a dispensing head in fluid connection to the fluid cart. The fluid cart can be connected to a station and a variety of different types of coating operations subsequently performed. The fluid can be readily disconnected from the station after the coating operation is complete, permitting a different fluid cart to be attached to the same station. The first fluid cart can then receive required servicing without idling the station to which it had been attached. Various embodiments of the means for coating the substrate and powering and controlling equipment of the coating apparatus are disclosed.

88 Claims, 9 Drawing Sheets

SYSTEM AND METHOD FOR INTERCHANGEABLY INTERFACING WET COMPONENTS WITH A COATING APPARATUS

REFERENCE TO RELATED APPLICATIONS

The present application is being concurrently filed with commonly assigned U.S. patent application, Ser. No. 09/227,692, filed Jan. 8, 1999, now abandoned, entitled "INTELLIGENT CONTROL FOR EXTRUSION HEAD DISPENSEMENT"; U.S. patent application, Ser. No. 09/227,362, filed Jan. 8, 1999, now U.S. Pat. No. 6,092,937, entitled "LINEAR DEVELOPER"; U.S. patent application, Ser. No. 09/227,607 filed Feb. 16, 2000, entitled "MOVING HEAD, COATING APPARATUS AND METHOD"; U.S. patent application, Ser. No. 09/227,381, filed Jan. 8, 1999, entitled "SYSTEM AND METHOD FOR CLEANING AND PRIMING AND AN EXTRUSION HEAD"; U.S. patent application, Ser. No. 09/227,459, filed Jan. 8, 1999, entitled "SYSTEM AND METHOD FOR ADJUSTING A WORKING DISTANCE TO CORRESPOND WITH THE WORK SURFACE"; the disclosures of which are incorporated herein by reference. Reference is also made to the following co-pending and commonly assigned U.S. patent application entitled "LINEAR EXTRUSION COATING SYSTEM AND METHOD, Ser. No. 09/148,463, filed Sep. 4, 1998; and U.S. patent application entitled "SYSTEM AND METHOD FOR PROVIDING COATING OF SUBSTRATES, Ser. No. 09/201,543, filed Nov. 30, 1998; the disclosures of which are incorporated herein by reference. The present application is a continuation of co-pending, commonly assigned Provisional U.S. Patent Application, Ser. No. 60/070,985 now expired, entitled "INTELLIGENT CONTROL SYSTEM FOR EXTRUSION HEAD DISPENSEMENT", filed Jan. 9, 1998 the disclosure of which is incorporated herein by reference.

TECHNICAL FIELD

This invention relates to the precision coating of surfaces and more particularly to extrusion coating of substrates wherein fluid storage, delivery, and dispensing means are contained within a module which can be removably attached to a station containing the remainder of a complete coating apparatus.

BACKGROUND

It is often necessary or desired to provide a coating of a particular substrate. For example, in the video electronics industry it is often desired to coat panels which will serve as flat panel displays (FPD) to be incorporated into television sets, computer monitors and the like. It is important in such applications to ensure the accuracy and consistency of coating thicknesses across the panel.

In the prior art, the fluid delivery means, including fluid supply, pumps, and dispenser or fluid extrusion head assembly, as well as the chuck, substrate and means for distributing a coating of the fluid on the substrate were all part of a single integrated coating apparatus assembly. As such, when it was necessary to change coating fluids, or perform other operations on the fluid delivery means, the entire coating apparatus would be idled. Fluid changeover operations include time consuming tasks such as cleaning all tubing, pumping mechanisms, and essentially all surfaces where residue of the previous coating material could be present. This thoroughness is often necessary because of potentially dangerous chemical reactions between two different coating materials to be used in succession, and because of the danger of cross-contamination between coating materials used in different processes. The idle time for the coating apparatus is expensive and wasteful given that mechanisms unrelated to the fluid delivery system are idled by the operations necessary for fluid changeover. Accordingly, a need exists in the art for a system and method wherein a chuck assembly adapted to position and hold substrates to be coated as well as other components and materials used in the coating process but not part of the fluid delivery system are not left idle during fluid delivery system cleaning operations.

Additionally, in order to avoid dripping or smearing coating material which has gathered around the extrusion head after a coating operation, it is often necessary to clean the extrusion head before a new coating operation begins. In the prior art, cleaning of extrusion mechanisms is usually accomplished manually, potentially leading to inconsistent results and disruption and delay of the coating operations. Therefore, it is a problem in the art that manual cleaning operations are inconsistent and unreliable.

In order to ensure that coating material is applied consistently and evenly right from the start of the coating operation, it is desirable to ensure that a bead is fully and properly formed at the extrusion head prior to starting the coating process. A problem in the prior art exists with respect to properly priming fluid extrusion heads so as to ensure that a proper bead is formed prior to extruding fluid over the substrate, that a consistent rate of coating fluid flow is thereafter achieved, and that the extrusion head can be quickly moved from the priming mechanism to the substrate.

Generally, in prior art coating systems, there is a single pump mechanism located remotely from the extrusion head with appropriate fluid conducting means leading from the pump the head. The use of a single pump, while perhaps economical, makes it difficult to precisely control fluid flow at the extrusion head. Specifically, it may be difficult to start and stop at precisely defined moments and to establish the precise fluid flow rate desired.

In prior art systems, variation in the height of the extrusion head with respect to the substrate can cause breaking of the coating bead and variation in coating thickness. The causes of such height variation include part dimension variation, part placement error, and gradual drift in machine dimensions over time. Accordingly, there is a need in the art for a system and method for ensuring constant extrusion head height over the substrate being coated.

Accordingly, there is a need in the art for a method and system for coating in which the idle time for apparatus not part of the fluid delivery process to be minimized while fluid is being changed or recharged.

A still further need in the art exists for a cleaning station whose functions are automatically accessible to a fluid dispenser in between coating operations.

A still further need in the art exists for a priming station which can be accessed automatically by a fluid dispenser in between coating operations.

A still further need in the art exists for more precisely controllable flow of coating material at the extrusion head.

SUMMARY OF THE INVENTION

These and other objects, features and technical advantages are achieved by a system and method in which the wet components, including the fluid supply, pumping means, fluid dispensing head and utility station operations are located on a carrier, or other device, hereinafter referred to as a mobile device or cart, although it should be appreciated that the present invention may be embodied in any number of devices not completely consistent with the chosen nomenclature, which is removably attachable to the remainder of the coating apparatus. The mobile device is preferably in the form of a cart or fluid station which contains all or substantially all of the components in the coating apparatus which come into contact with coating fluid. The portion of the coating apparatus not part of this mobile fluid module, or fluid cart would preferably contain a chuck and shuttle mechanism, or other transport means. The non-fluid portion of the coating apparatus will be referred to as a base station or work station.

The fluid cart and base station preferably both contain means for being secured together in preparation for a coating operation employing a chosen cart. Means for accomplishing this attachment include but are not limited to clips, clamps, rollers on beams which are forced against a rigid surface, and grippers which may be actuated by electrical, pneumatic, and hydraulic means. Preferably, in the context of a plurality of carts with different coating materials and different types of dispensers on board, and possibly, a plurality of base stations, any cart can be mechanically attached, and appropriately interfaced to any station among the plurality of carts and stations, wherein the interface may serve to transfer information, power, and facility connections such as exhaust or drain connections, by a variety of means including electric, pneumatic, hydraulic, or wireless.

Preferably, both the fluid cart and base station both comprise means for communicating with the other. The need for coordinating fluid flow rates with relative velocity of the dispenser with respect to a substrate among other parameters create a desire for such communication. The communication link between the cart and base station may be made by wire or cable or may be wireless, and is preferably under computer control. If the communication is accomplished via a hard wire connection, this connection will preferably be automatically made when the cart and base station are mechanically joined. Alternatively, the wired connection may be made manually either before or after a rigid mechanical attachment between the cart and base station is accomplished. Upon removing a cart from a base station, all connections made when first joining the cart and base station are disconnected.

In a preferred embodiment, the dispenser, coating head, or extrusion head is associated with a cart as is other equipment with comes into direct contact with the coating fluid. This approach obviates the need to clean the dispenser in between coating operations involving different fluids, and minimizes the amount of mechanical connection and disconnection necessary when changing carts. A preferred embodiment of the cart includes a cowl assembly substantially sealing any exposed wet components, such as the aforementioned head, in order to allow their continued contact with the coating fluid without fear of contamination or evaporation when not in use. Accordingly, various carts may be configured for particular coating operations which are repeated throughout a day or week without requiring the cart to be fully checked when idle, but expected to be subsequently put back into service.

In order to properly service fluid carts when they are not attached to base stations and engaged in coating activity, docking stations are deployed which provide connections for operating equipment on the cart, such connections including but not limited to electrical, pneumatic, hydraulic, and wireless. In a preferred embodiment, servicing the carts requires that the various pumps, switches, and other devices be powered and properly controlled. The docking station also provides appropriate connections and control as well as appropriate containers and supplies for removing unwanted fluid from the cart, supplying fresh fluid to the cart, and for appropriately cleaning equipment on the cart.

Preferably, fluid supplied to the cart from the docking station includes fresh coating material, and fresh solvent of one or more types used in the head cleaning and priming operations on the fluid cart. Fluid removed from the cart to the docking station includes coating material which is not needed in a subsequent operation, or which has degraded over time to an unacceptable level of quality, or otherwise become contaminated, and used solvent material from the cleaning and priming assembly. The used solvent from the cleaning and priming operations may optionally be subsequently transferred to recycle and recovery station.

The following discussion acknowledges various possible relative motion configurations which may be used by a coating apparatus adapted according to the present invention. For example, a primarily moving head configuration is one in which the majority of the relative motion of a substrate with respect to a dispenser or dispensing head is due to movement of the dispenser over a mostly stationary substrate. Conversely, a primarily moving substrate, or moving chuck configuration is one in which the majority of the coating motion is due to motion of the chuck and substrate (it is assumed here that the substrate does not move with respect to the chuck) under a mostly stationary head, such as by the substrate being moved with respect to the dispenser during deposit of the fluid or by allowing a pool of fluid to be deposited and then spinning the chuck and substrate to distribute the fluid. Motion of the dispenser with respect to substrate could be initiated by means on either the cart or the base station, or both.

In a preferred embodiment of the invention, the base station is able to perform the same fluid removal and replenishment operations with respect to the fluid cart as described above in connection with the docking station.

Preferably, upon attachment of a preferred embodiment cart to a base station, a preferred embodiment dispenser would then be appropriately mechanically attached to a mount on the base station, whether a primarily moving head or primarily moving substrate configuration is in place. In the case of the moving head configuration, the mount for the dispenser would be attached to a shuttle mechanism or transport system which would move the dispenser over the substrate. In the case of a moving substrate configuration, the dispenser would be mounted on a point accurately fixed with respect to the chuck and substrate moving underneath the mounting point. Of course, the cart may include a shuttle or gantry assembly allowing the dispenser to be mounted thereon and positioned properly with respect to the base station without actually mounting the dispenser to the base station, if desired.

Even after being mechanically positioned on the base station, the dispenser would remain in communication with the cart, as the cart would continue to supply fluid to the dispenser, and in a preferred embodiment, to supply power and control information to a pump integrally mounted on the dispenser. Therefore, the cart will at least have a fluid connection to the dispenser. Additional possible connections between the dispenser and fluid cart include but are not limited to electrical control cabling, wireless broadcast, pneumatic lines, hydraulic lines (other than for coating fluid).

Mechanically mounting the dispenser on a portion of the base station permits the benefits the positioning accuracy of various parts of the base station with respect to each other to govern the relative locating accuracy between the dispenser and the substrate surface, and diminishes the level of precision required in the positioning of the cart with respect to the base station. The cart should nevertheless preferably be rigidly enough attached to the station so that no disruption in the various fluid and other connections occurs. However, mechanically mounting the dispenser on the base station means that imperfect mating of a cart and a base station when they are first attached, or minor relative movement of two with respect to each other during coating should not affect the mechanical precision of the coating operation. Moving the dispenser from the cart to the base station mount can be accomplished either manually, or automatically, preferably under computer control.

As mentioned above, the inventive mechanism is not restricted to an embodiment in which the dispenser is mounted to a portion of the base station in preparation for the coating operation. In an alternative embodiment, the dispenser could remain on or mountably attached to the fluid cart during coating. This embodiment may place an increased burden on the accuracy of positioning of the cart or at least the mechanism used to mount the dispenser with respect to the base station while the two are attached where relative positions of the dispenser and substrate are critical.

Using the present invention, each cart may be associated with a particular fluid or with a particular size or type of coating head. When a cart becomes unusable such as because the fluid supply has been exhausted, the fluid supply becomes unusable due to degradation over time, or because the current manufacturing process requires using a different coating fluid, the attached cart can be readily and rapidly disconnected from the base station. A new cart can then be immediately attached to the main station, and the dispensing head on the new cart attached to an appropriate mounting position on the base station.

Coating operations can thus quickly resume independently of the time consuming task of cleaning and readying for operation the fluid system on the old cart. The old cart can be cleaned and prepared for renewed operation at a docking station in parallel with the resumption of coating operations at the very same base station. The idle time experienced in the systems of the prior art is thereby minimized since coating operations need cease only during the disconnection and connection of carts and relocation of dispensing heads.

In a preferred embodiment of the present invention, utilities for servicing the fluid dispensing head may be located on each fluid cart within a range of travel of the fluid dispensing head as carried by a shuttle mechanism or other transport system of the preferred embodiment base station. Locating such utilities on the cart permits the features of the utilities, including but not limited to cleaning and priming of the dispenser, to be optimized for the fluid and dispensing head resident on that cart. For example, a cart carrying a particular fluid and a particular dispenser would contain scrubbers and solvents particularly suited for both the fluid and dispenser associated with that cart. Otherwise stated, the various components present on, or associated with a particular cart can be coordinated with each other for optimum system performance.

A shuttle on the base station can be automatically programmed to stop at utility stations on the fluid cart at appropriately selected times, such as between coating operations. A set of utilities could include a scrubbing station at which bulk coating material would be removed from the dispensing head through a combination of physical scrubbing with brushes in combination with use of a solvent. Such a scrubbing station is particularly useful if the most recently used coating material is highly viscous.

Another operation among these utilities preferably consists of a rinsing station at which a powerful solvent removes any material remaining from the most recent coating operation, even if the dispensing has been cleaned at the scrubbing station. The solvent used at the rinsing station is preferably selected so as to remove any solvent remaining from the scrubbing operation and any residual coating material, and so as to evaporate rapidly after completion of the rinsing operation thereby obviating the need for any further cleaning action.

Yet another operation among these utilities could consist of a priming station at which the dispensing head could be placed so as to ensure that a full and consistent bead of coating fluid is made ready at the dispensing head in preparation for the next coating operation, as well as to extract any coating fluid from the dispenser which may have been contaminated with or diluted by a cleaning solvent or other matter. A preferred embodiment for such a priming station consists of rotating cylinder upon which coating fluid is placed in the smallest quantity necessary to establish a consistent bead or to remove contaminated coating fluid from the dispenser. In this embodiment, holding the dispensing head stationary in proximity to the rotating cylinder effectively simulates moving the dispensing head over a certain length of surface material, without requiring the space such a length of surface material would occupy.

In a preferred embodiment of the present invention, at least one primary pump located remotely from the dispensing head, preferably on the fluid cart, would pressurize the fluid connections leading up to a dispensing head assembly, and a second smaller pump, preferably integrated into the dispensing head assembly, would accurately control the flow of fluid to be dispensed or extruded onto the substrate surface. Implementation of such an integrated pump on head arrangement would require communication and control connections to be made between the cart and the dispensing head. These connections, as well as the main coating material fluid connection are preferably coiled and located in such a manner as to not have their function disrupted in any way by motion of the dispenser on a shuttle mechanism or other transport means. A preferred mechanism for avoiding interference with the various cables, tubes, hoses and the like, necessary for connections to the dispenser and shuttle mechanisms and other devices, is the deployment of troughs preferably along the sides of the base station in which these connecting means may be placed.

In a preferred embodiment of the present invention, the means for moving the head and substrate to be coated with respect to each other is achieved by moving the head over a mostly stationary substrate. Using this embodiment, the footprint of the apparatus in the horizontal plane is much reduced with respect to a configuration in which the substrate travels a distance equal to its own length underneath a fluid dispenser. Using the moving head embodiment, the length of the system need only exceed the length of the substrate by the amount necessary for the fluid dispensing mechanism to move clear of the substrate, for purposes of substrate placement and removal, and possibly for the placement of utilities to service the fluid dispenser in between coating operations.

The moving head embodiment is adaptable to large substrate sizes as the nature of the chuck assembly design would change little with increasing substrate size. A single coating apparatus can be used with substrates of different sizes by employing a head of appropriate length and ensuring the shuttle mechanism has sufficient travel to cover the lengths of the various substrates to be coated. Where a larger substrate cannot be accommodated by a particular coating apparatus, the principal changes required for such apparatus to accommodate a larger substrate would be to appropriately increase either the width and/or travel of the shuttle mechanism and the length (span) of the fluid dispenser, and to adjust the size the chuck. Increasing the size of the substrate does not significantly increase the stresses on the moving means in a moving head embodiment. Whereas, in a moving substrate environment, the weight to be carried by the moving means, and the stresses thereon increase considerably with increasing substrate size.

A shuttle mechanism which carries the fluid dispenser preferably rides on an air bearing or alternative support and guidance mechanisms such as rolling contact with a rail system, or low friction contact surface, located underneath the chuck assembly, the shuttle mechanism thereby forming a single continuous rigid loop structure. The rigidity of this design optimizes the precision with which the coating apparatus can operate. This configuration also limits the width of the apparatus by obviating the need for a support surface beyond the width of the chuck assembly, thereby further reducing the footprint of the coating apparatus. The shuttle mechanism, with its air bearing below the chuck a carriage to carry the fluid dispenser above the chuck and substrate, and structural links connecting the two, effectively envelops the chuck thereby restricting the permitted thickness of the chuck assembly and equipment contained therein.

Although the modular fluid cart concept is preferably employed in conjunction with coating apparatus employing a moving head apparatus, the concept is not limited to this configuration. The modular fluid cart could be attached to a base station wherein the substrate to be coated moves underneath a mostly stationary dispensing head, or extrusion head. More generally, the base station to which the fluid cart is attached could employ any combination of dispenser and substrate movement in order to accomplish an appropriate coating motion.

Accordingly, it is a technical advantage of the present invention that the idle time for apparatus not part of the fluid delivery process is minimized while coating fluid is changed or recharged.

It is a further advantage of a preferred embodiment of the present invention that the various devices and utilities located on a particular fluid cart may be selected for optimal interaction with each other.

It is a still further advantage of the present invention that flow of coating material at the dispensing head is more precisely controllable than in prior art systems.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

The present invention is described in the context of depositing a coating on a surface of a variety of devices including but not limited to flat panel displays and integrated circuit substrates. This is a known manufacturing technique which is described for illustrative purposes only. The process liquid may be a photoresist, developer, etchant, chemical stripper, solder mask, or any other liquid chemical, or other sufficiently available substance to allow its use in coating of substrates used in the manufacture of devices such as integrated circuits, flat panel displays and the like, as well as other sophisticated devices such as multi-chip modules (MCM's) and high density interconnect (HDI) chips used in mainframe computers, telecommunication switching systems, military electronics and other high-end devices. The present invention is not limited to any particular coating liquid, substrate or end product, and the principles of the invention should be broadly construed to any coating application regardless of the particular liquid, substrate or end product.

Figure 1:
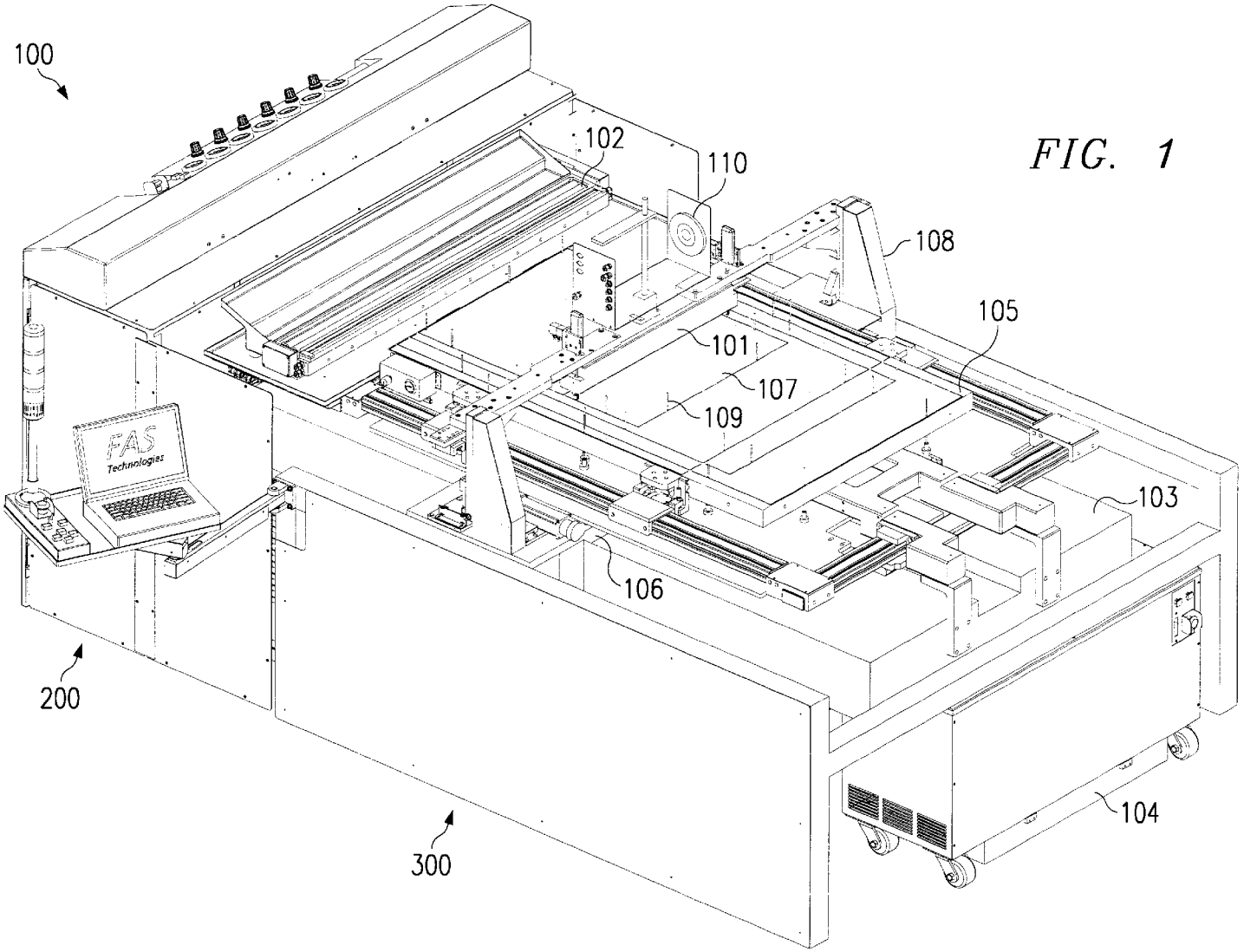
FIG. 1 depicts an perspective view of a coating apparatus with a fluid cart according the preferred embodiment of the present invention attached to a base station, with a dispenser suitably mounted on the base station.

FIG. 1 depicts an isometric view of a coating apparatus 100 according to a preferred embodiment of the present invention, comprising a preferred embodiment fluid cart 200 joined with a preferred embodiment base station or work station 300.

The fluid cart 200 is a preferred embodiment of a preferably mobile, modular, removably attachable fluid delivery system comprising all or substantially all of the components of the coating apparatus which contact coating fluid in the course of operation of said coating apparatus 100. The modular removably attachable fluid delivery system is preferably mobile with said mobility being enabled by rolling contact or low friction contact with a floor, or rolling or sliding contact with a rail system. Alternatively, the fluid cart could be transported without contacting a floor or other surface, by mechanized means, under either manual or automatic control.

On the preferred embodiment base station 300, a motion interface which is preferably a bearing mechanism which could be an air slide made of granite or other hard rigid material, but alternatively could comprise a rail system with frictional or rolling contact, or electromagnetic suspension, forms a foundation along which the shuttle mechanism or transport system travels for cleaning and coating operations. The preferred embodiment fluid cart 200 is at one end of the air slide, and an electrical control unit 104, preferably part of the base station, at the other end of the air slide 103, though it may be remotely located. The fluid cart 200 may include a utility station 102. The utility station, if included, preferably includes facilities for scrubbing, rinsing, and/or priming the dispenser or dispensing head 101.

Figure 9A:
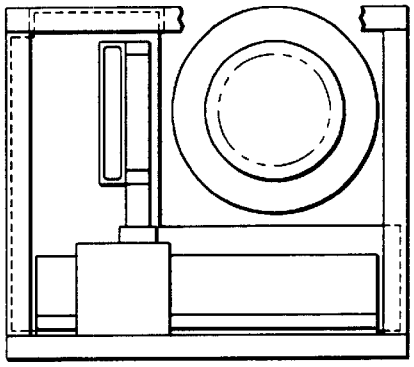
FIGS. 9A–9C show a substrate coating station module of the present invention having an extrude and spin sub-module deployed therein.
Figure 9B:
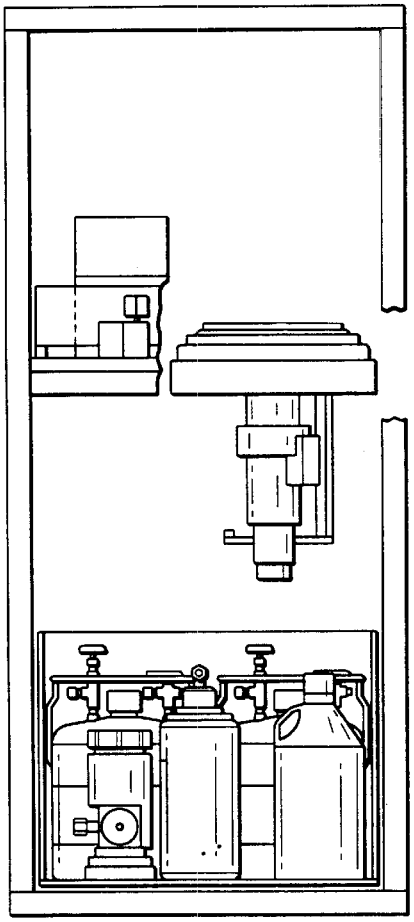
Figure 9C:
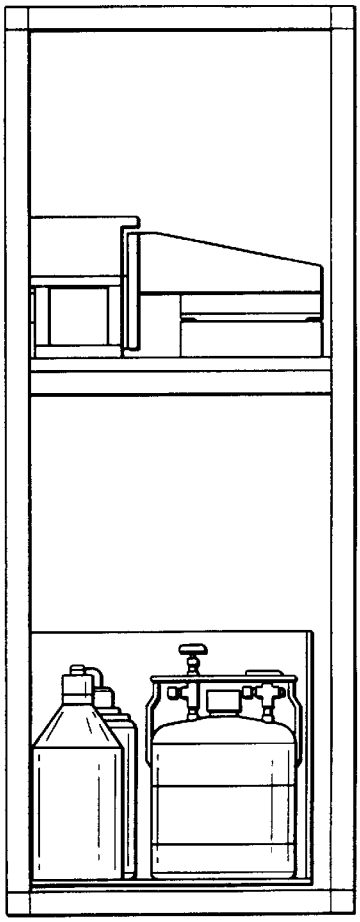

A chuck 105 is suspended above the air slide 103 to allow a bearing for a shuttle mechanism or other transport system to pass beneath, and the dispensing head 101 above, the chuck. The chuck 105 supports the substrate 107. The bearing 106 of shuttle mechanism 108 rides along air slide 103 underneath the chuck 105, while the dispenser, or dispensing head 101 moves above the chuck 105 supporting substrate 107. The dispensing head is preferably a linear extrusion head attached to fluid manifold preferably containing a bead forming orifice substantially as described in U.S. Pat. No. 4,696,885, titled "METHOD OF FORMING A LARGE SURFACE AREA INTEGRATED CIRCUIT", the disclosure of which is incorporated herein by reference. It will be appreciated that the present invention may be practiced employing a work station which comprises apparatus for spin coating fluid onto a substrate, as shown in FIGS. 9A–9C.

The travel of the shuttle mechanism 108 preferably will be at least long enough to permit the dispensing head 101 to completely coat the largest substrate to be placed on the apparatus 100, although this range may be reduced by providing for some movement of the substrate during coating, and to clear the substrate by a sufficient distance to permit the substrate to be removed by external personnel or machinery.

The substrate 107 is preferably raised from the chuck 105 prior to removal of the substrate 107 from the coating apparatus 100 preferably using substrate lift pins 109 located underneath the substrate surface, or alternatively by reversing the vacuum in the chuck, gliding or rotating devices under the substrate to raise the substrate, or by lifting a portion of the substrate which protrudes beyond the surface of the chuck 105. The travel of the shuttle mechanism 108 will preferably also be long enough so that in addition to clearing the substrate 107, the shuttle mechanism will be able to gain access to utility station 102.

In order to minimize the system footprint and improve coating performance, particularly on the leading edge (edge nearest the utility station) of the substrate 107, the substrate 107 will be located as close as possible to the utility station 102. Preferably, the shuttle mechanism 108 carries the dispensing head 101 to the utility station 102 for head cleaning and for priming of the bead either before or during the loading of the substrate 107. The preferred embodiment shuttle mechanism 108 then carries the dispensing head 101 to the near edge of the substrate 107 (the side closest to the utility station 102) so that coating of the substrate 107 may begin. The shuttle mechanism 108 then carries the dispensing head 101 across the substrate at a carefully monitored and preferably predetermined rate, preferably under computer control, while the dispensing head 101 dispenses coating material at a controlled rate over the substrate 107.

The shuttle velocity and coating fluid dispensing or extrusion rate, while preferably predetermined, may also be selected just prior to coating or even during coating if the coating operation would benefit from doing so. Such in-process change in linear transport velocity (coating velocity) and fluid extrusion rate would preferably be controlled and coordinated by control means so as to ensure a fluid coating possessing the desired characteristics. Reasons for changing the selection of coating velocity and fluid extrusion rate could result from changes in ambient air conditions, and the parameters of the fluid including but not limited to viscosity, temperature, pressure, and the proportion of solid matter dissolved in the fluid.

In a preferred embodiment, the rate at which the shuttle mechanism 108 moves is coordinated with the rate of fluid flow to the dispenser 101 from the fluid cart 200. Enabling such coordination requires that the base station 300 and the fluid cart 200 have communication means between them, which preferably include but are not limited to electrical wiring and wireless communication.

Once the shuttle mechanism 108 has traveled to a point where the dispensing head 101 has coated the entire substrate 107, fluid flow to the dispensing head 101 is preferably discontinued. In a preferred embodiment, the dispenser 101 comprises an integrally mounted pump-on-head 110 which can accurately control the flow of fluid to the dispenser, such fluid having been initially pressurized and delivered to the dispenser by pumping means located on the fluid cart 200. The pump-on-head assembly 110 permits initiation and discontinuation of fluid flow to occur more accurately and rapidly than when using only remote pumping means, such as that located on the fluid cart 200. Alternatively, the fluid will not have been initially pressurized by remote pumping means, and the pump-on-head assembly will perform all required fluid pressurization and flow control by itself.

Preferably, the substrate 107 is then removed prior to moving the shuttle mechanism 108 back to the utility station 102 to avoid any accidental dripping of coating material onto the substrate 107. The shuttle mechanism 108 is then preferably moved to the utility station 102, and another substrate 107 subsequently loaded onto the chuck 105. Employing a preferred sequence of operations, the dispensing head 101 is never above a substrate 106 except when performing a controlled coating operation. Of course, in alternative embodiments, such as when a coating fluid is of sufficient viscosity so as not to present a drip hazard, the sequence of head movements may be different than that outlined above. For example, after servicing, the head may be moved over a substrate loaded onto chuck 105 to begin coating from the far edge toward the near edge. Of course, substrate 107 may alternatively be loaded after the head has moved to the far end, if desired. Similarly, the head may be returned to a home position, passing over a freshly coated substrate, prior to removal of the substrate from the chuck, if desired.

Alternately, the shuttle 108 could remain in position near the electrical unit 104 end of the base station after the coating operation and permit external machinery to remove the substrate 107 from the coating apparatus 100. Such an approach could be used for example, if the nature of coating material was such that the dispenser 101 did not require cleaning and priming prior to the next coating operation, or if the coating material is sufficiently viscous that no danger exists of dripping material onto the substrate during shuttle 108 travel back toward the fluid cart 200. Moreover, the return travel of the head may be utilized in coating a second substrate loaded after removal of the first and while the shuttle remains in the position near electrical unit 104, thus improving throughput of the coating apparatus. It is noted that the preferred embodiment pump on head 110 permits negative pressure to be applied to the dispenser thereby aiding in the prevention of any unwanted extrusion.

In a preferred embodiment, a height sensing and adjustment mechanism is implemented on the shuttle mechanism 108 to fine tune the gap between the dispensing head 101 and the substrate 107 in real time during the coating operation. Sensing means is appropriately zeroed while the head 101 is at the correct height, and a correction signal is subsequently generated whenever the height deviates above or below the preset level. The height sensing means can consist of a rod with a roller base which rolls along the substrate, or a surface parallel to the substrate. Such an arrangement would provide direct linear position feedback reporting the height of the dispenser or dispensing head above the substrate. An alternative means for height measurement would be to measure dispenser height over the substrate based upon the position of the height adjustment motor on the shuttle mechanism 108. Using motor position information for height control constitutes indirect position feedback. Alternative technologies for conducting height sensing include optical, sonic, ultrasonic, hall effect, mechanical contact using friction or rolling contact, air back pressure, and electromagnetic. These methods also constitute direct position feedback.

A control system, preferably comprising computer hardware and software, converts this signal into information suitable to drive a motor or other driving means to restore the dispensing head to the proper height. This process of height self-correction begins at the start of the coating process and continues throughout the coating process. Control of the automatic height correction process can be handled either by main host software or delegated to a control sub-system which performs the height control function without burdening the main host software.

Figure 2:
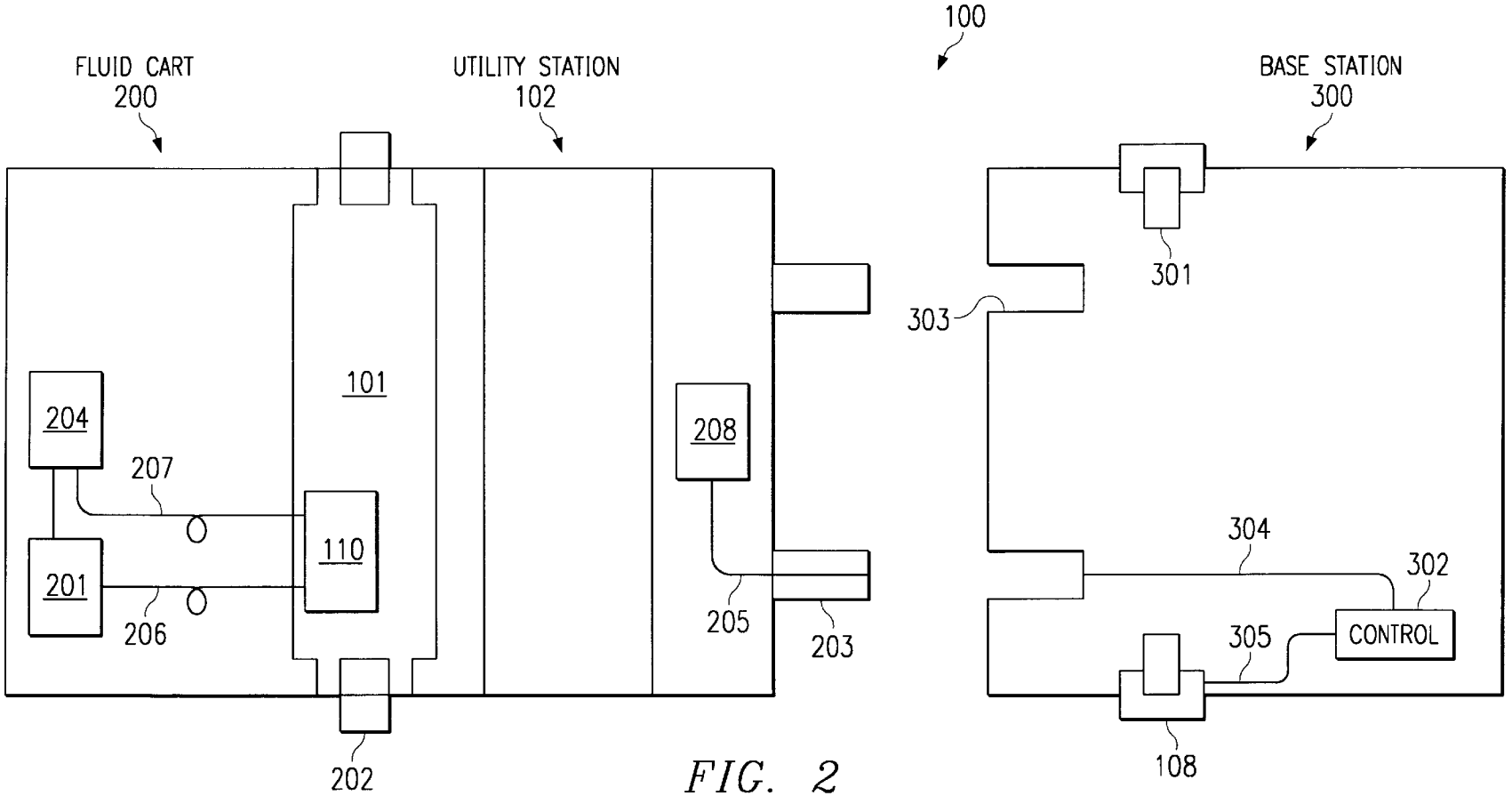
FIG. 2 depicts a top view of fluid cart and base station of the preferred embodiment.

FIG. 2 depicts a top view of fluid cart and base station of the preferred embodiment. The fluid cart 200 and base station 300 are shown separated but ready for attachment.

In the preferred embodiment of the present invention, the fluid cart 200 comprises fluid storage and pumping means 201. The pumping means may comprise one pump, or a plurality of pumps, connected to a fluid reservoir. Fluid pressure supplied by pumping means on the cart is sufficient to provide controlled fluid flow to the dispensing head 101, even when the dispensing head is located at the far end of the base station 300 from the pumping means on the fluid cart. In the preferred embodiment, pumping means on the cart may be supplemented by a pump on head 110 which is integrally mounted on the dispenser or dispensing head 101.

In the preferred embodiment, the dispenser head mounts 202 on the fluid cart 200 support the dispenser 101 while it is located on the fluid cart 200. Before beginning coating with a recently attached cart, the dispenser in communication with said cart is preferably moved either manually or automatically from the fluid cart mounts 202 to the base station mounts 301 located on the shuttle 108 or other transport system. In the case of the fluid cart mounts 202, and the base station mounts 301, mounting may occur by a variety of means including but not limited to clamps, clips, nut and bolt attachment, ball joint, spring loaded locking mechanism, or electrically, pneumatically or hydraulically powered gripping means.

In the preferred embodiment, the rigid attachment of the dispenser 101 to the shuttle 108 ensures that the accuracy of placement of the dispenser 101 on the station benefits from the tolerances present in the machining of the base station 300 and the precision with which the shuttle 108 is located with respect to the stationary parts of the base station 300. After attachment to the base station mounts 301, the accuracy of dispenser location with respect to the base station 300 or a substrate located on the base station 300 is independent of the precision present in the attachment of the fluid cart 200 to the base station 300.

In a preferred embodiment, a utility station 102 is present on the fluid cart. The utility station 102 preferably comprises means for scrubbing, rinsing and priming the dispensing head 101. The utility station 102 is preferably located at such a point on the fluid cart 200 that the shuttle 108 can carry the dispenser to the portions of the utility station 102 under automatic control.

In the preferred embodiment, connections between the fluid cart 200 and the dispenser 101 are maintained while the dispenser is mounted on the shuttle 108 and traveling over the base station 300. These connections should be set up so as to permit the dispenser to travel without any disturbance in the function of the various devices serviced by the connections and so as not to physically interfere with the operation of the shuttle 108 or any other component of the cart 200 or station 300. A plurality of connections between the cart 200 and the dispenser 101 are preferably used including but not limited to fluid cable 206, and control cable 207. The fluid cable 206 carries fluid from the fluid storage and pumping means 201 on the cart to the dispenser 101, as well as return lines for fluid from the pump on head 110 back to the fluid reservoir.

In a preferred embodiment, the control cable 207 exercises control over equipment located on the dispenser 101 and receives information from sensory devices located on the dispenser (not shown). This control over dispenser equipment may be accomplished by electrical, hydraulic or pneumatic means. The equipment on the dispenser to be controlled may include but is not limited to valves, motors, and an integrally mounted pump on head 110. Sensory devices located on the dispenser 101 may include but are not limited to devices for measuring fluid flow velocity, fluid pressure, air or fluid temperature, coating thickness, or still other characteristics of fluid within the dispenser, as well as non-fluid characteristics such as dispenser height over a substrate to be coated, ambient air characteristics, mechanical vibration, and direct measurement of dispenser velocity.

In a preferred embodiment of the present invention, the cables leading from the fluid cart 200 to the dispenser or extrusion head 101 are physically arranged so that they do not interfere with any function of the cart 200 or base station 300. In the preferred embodiment, space is provided for slack in cables 206 and 207 in troughs along the sides of the base station. Alternatively, the cables could be suspended above the workspace.

The cart 200 and base station 300 are preferably mechanically attached to permit proper operation of the coating apparatus as a whole. Accordingly, the preferred embodiment fluid cart 200 has attachment means 203 which mate with base station 300 attachment means 303. In a preferred embodiment, means for interfacing control information are incorporated within attachment means 203 and 303. Such means include but are not limited to electrical contacts, fiber optic contacts, and pneumatic or hydraulic connections. Means for accomplishing the mechanical attachment include but are not limited to clamps, rollers on beams which are forced against a rigid surface, clamps, and grippers which may be actuated by electrical, pneumatic, magnetic, electromagnetic, and hydraulic means.

Control interface cable 205 on the cart 200 is shown leading from attachment means 203 back to a junction box 208. In a preferred embodiment, a junction box 208 establishes all needed electrical contact between the control interface cable 205 leading to electrical interface at the attachment means 203 and the various electrical control equipment, utilities or power supplies located on the fluid cart. Any pneumatic and hydraulic connections made between the cart 200 and the base station 300, may also be integrated into the attachment means 203 and 303.

Alternatively, the electrical and other utility connections between the cart 200 and base station 300 could be made separately from the mechanical attachment means 203 and 303. In this alternative embodiment, cables leading to modular connectors for any or all of electrical, pneumatic or hydraulic connections from both the cart 200 and the base station 300 could be joined, either manually or automatically, once the cart 200 and base station 300 are in sufficient proximity to permit such connections. Preferably, the connection of electrical and other utility cables between the cart 200 and base station 300 are made first, and the cart 200 is then fully docked, or mechanically attached to the base station. Alternatively, the connection of modular utility cables between the cart 200 and base station 300 occurs after the cart and station have been attached mechanically. The utility and mechanical connections could also be made simultaneously.

In a preferred embodiment, control means 204 are mounted on the cart. This control means may comprise a connection to a host computer, a dedicated processor, personal computer, programmable logic controller, or other control device. Preferably, control means 204 on the cart 200 controls the primary pump located on the fluid cart, a pump on head, or integrally mounted head pump 110 if present on the dispenser. The control means can also control equipment within the utility station 102 if disposed on the fluid cart 200, such as rotation of scrubbers and a priming roller, and the flow of fluid to a scrubbing and rinsing stations. In a preferred embodiment, the cart control means 204 receives information from sensory devices such as a height sensor. Additional possible sensory information which can be received by the control means 204 includes fluid characteristics such as pressure, temperature, and fluid flow velocity and dispenser mechanical characteristics such as position and velocity with respect to the substrate 107.

In a preferred embodiment, control means 302 attached to or in communication with the base station 300 controls the position and velocity of the shuttle mechanism 108 or other transport system, in at least two linear dimensions, such as the coating direction and vertical motion. The base station control means 302 would preferably also control the general sequence of events of the coating apparatus 100. More specifically, in a preferred embodiment, the base station control means 302 would typically instruct the shuttle 108 to move above various components of the utility station 102, and when finished, to proceed to a starting point for the coating operation. When all is ready for the coating operation, the base station control means 302 would preferably move the shuttle at a controlled velocity over the substrate to be coated. When the coating operation is complete, the control means 302 can move the shuttle 108 to move clear of the substrate, in either direction, to permit external equipment to pick up the coated substrate.

As will be discussed in more detail later, in an alternative preferred embodiment, the functions of the cart control means 204 and base station control means 302 may be performed, or at least coordinated, by a single computer. A single computer could perform the coordination and still employ other processors to which the host computer delegates certain tasks such as, for example, height sensing and adjustment, or fluid flow control.

In a preferred embodiment, coordination between cart control means 204 and base station control means 302 is employed for a number of the functions of the coating apparatus 100. For example, while the coating process is under way, there is a need to coordinate the velocity of the shuttle 108 carrying the dispenser 101 with the rate of deposition or extrusion of the coating fluid. Further, where height adjustment is employed, the height sensor preferably feeds height measurement information back through the control cable 207 to control means 204 which routes this information to base station control means 302 via control interface cable 205 and interface within the attachment means 203. The recited list of examples is illustrative and not comprehensive.

In order to properly ascertain various process parameters, the cart 200 and base station 300 will preferably identify the other component of its "identity". In this context, the identity of a cart 200 refers to the type of fluid and type of dispensing head it is carrying. Communication of such information as quantity of fluid stored on the cart, presence or absence of an integrated head pump 110, and presence or absence of a height sensor on the dispenser could also be communicated.

In the reverse direction, a base station 300 would preferably communicate the length of travel of the shuttle. Other information communicated by the base station 300 would preferably describe the nature of the substrate to be coated, and the type and amount of coating material required for that substrate. The information exchanged between the two components of a full coating apparatus 100 would preferably ensure, before actual coating begins, that the two components are properly matched for the coating operation to be undertaken.

In an alternative preferred embodiment, a single centralized control system, preferably in the form of a personal computer, in communication with the various devices on both the cart 200 and the base station 300 would control the individual devices and perform any required coordination between two or more functions which must function in concert with one another for the coating operation to be successful. With this embodiment, the coordination between shuttle velocity and fluid flow rate would preferably be performed by having the computer or other centralized control means simultaneously communicate with the shuttle mechanism 108, fluid delivery means 201 and 110, and sensors indicating the velocity of the shuttle and the fluid, perform any required calculations, and control both the pumps and the shuttle so as to achieve a coating satisfying all process parameters, including but not limited to thickness, uniformity, and material purity.

In order to have access to all equipment to be controlled, and all sensory information within the coating apparatus 100, the centralized computer would preferably be connected to the base station on a quasi-permanent basis, thereby having ongoing uninterrupted access to the equipment and sensors on the base station 300. Specifically, contact between the computer and the base station would be independent of the connection status between the cart and station. With this arrangement, the computer would acquire the ability to communicate with, and control equipment on the fluid cart 200 only once a control cable connection or other interfacing mechanism is implemented between the fluid cart 200 and the base station 300.

Having discussed embodiments in which control means are located on both the cart 200 and the base station 300, and an embodiment in which a single centralized computer performs all the required monitoring and control, it is noted that the inventive mechanism is not limited to any particular number of control systems or to any set of possible distributions of computing activity between such control systems. The invention may be practiced with any number of control systems and with a wide range of possible distributions of control and sensory measurement receiving between them. A few examples have been discussed above purely for purposes of illustration and are not meant to limit the invention to the control configurations discussed therein.

The interchangeable fluid cart invention has been discussed in the context of a base station in which the relative motion between the dispenser 101 and the substrate 107 results from a shuttle mechanism 108 carrying a dispenser 101 over a mostly or completely stationary substrate. The invention is however, not limited to this "moving head" configuration. The invention may be practiced with a base station in which a chuck supporting a substrate moves with respect to a mostly or completely stationary dispenser.

Figure 3:
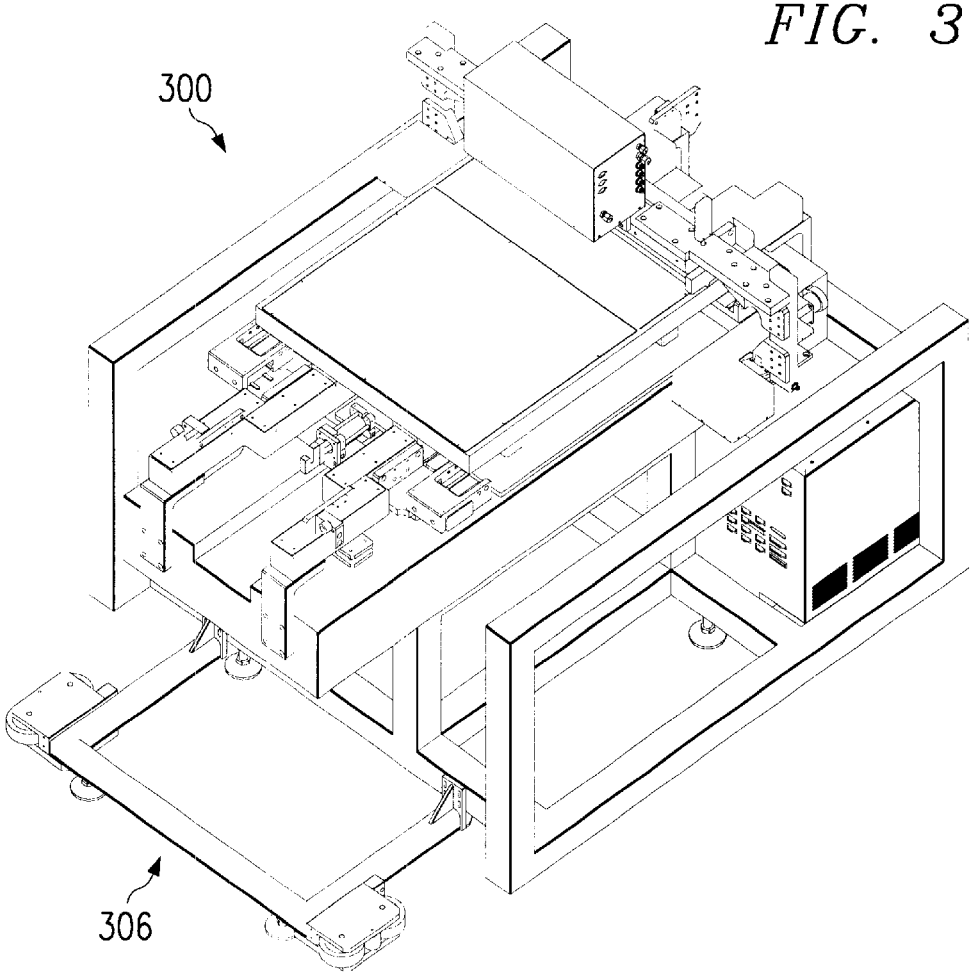
FIG. 3 depicts a perspective view of a preferred embodiment of the base station of the present invention.

FIG. 3 depicts a perspective view of a preferred embodiment of the base station of the present invention. The base station embodiment of FIG. 3 shows roller locking mechanism 306 for mechanical attachment to a fluid cart (not shown).

Figure 4:
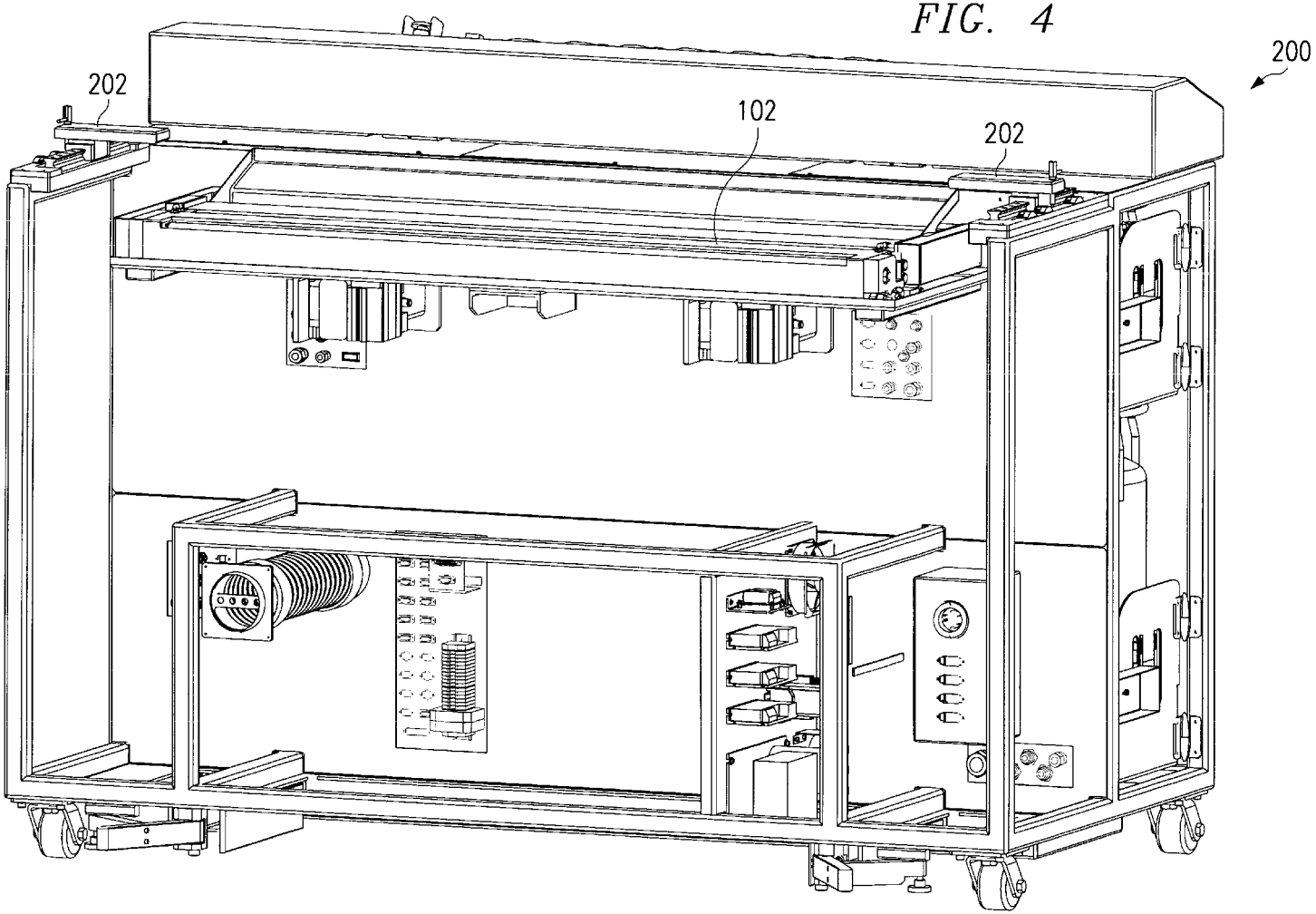
FIG. 4 depicts a view of the front of a fluid cart according to a preferred embodiment of the present invention.

FIG. 4 depicts a view of the front of a fluid cart according to a preferred embodiment of the present invention. Preferred embodiment dispenser head mounts 202 are shown with no head present. A preferred embodiment utility station 102 is also shown.

Figure 5:
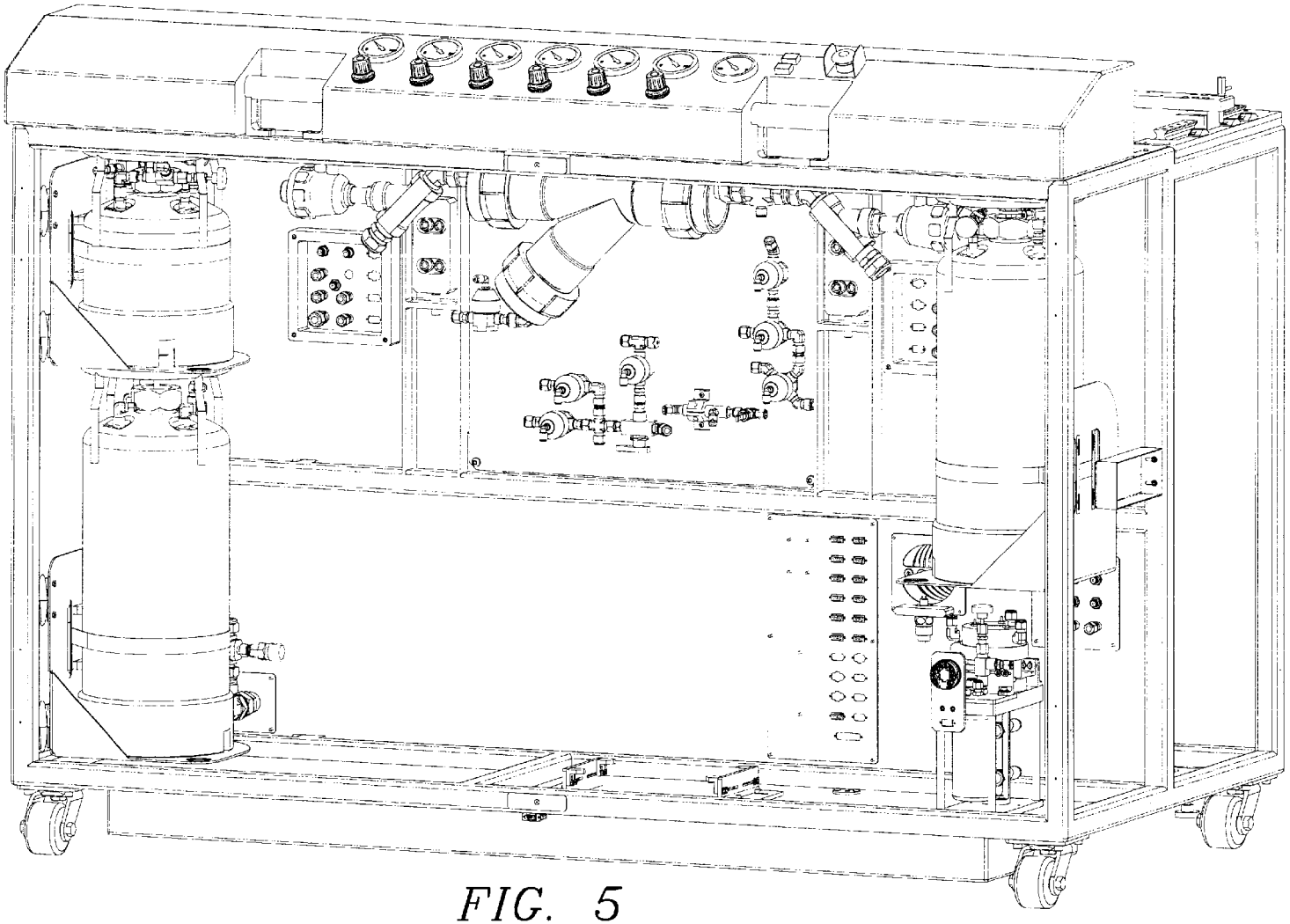
FIG. 5 depicts a view of the rear of a fluid cart according to a preferred embodiment of the present invention.

FIG. 5 depicts a view of the rear of a fluid cart according to a preferred embodiment of the present invention.

Figure 6:
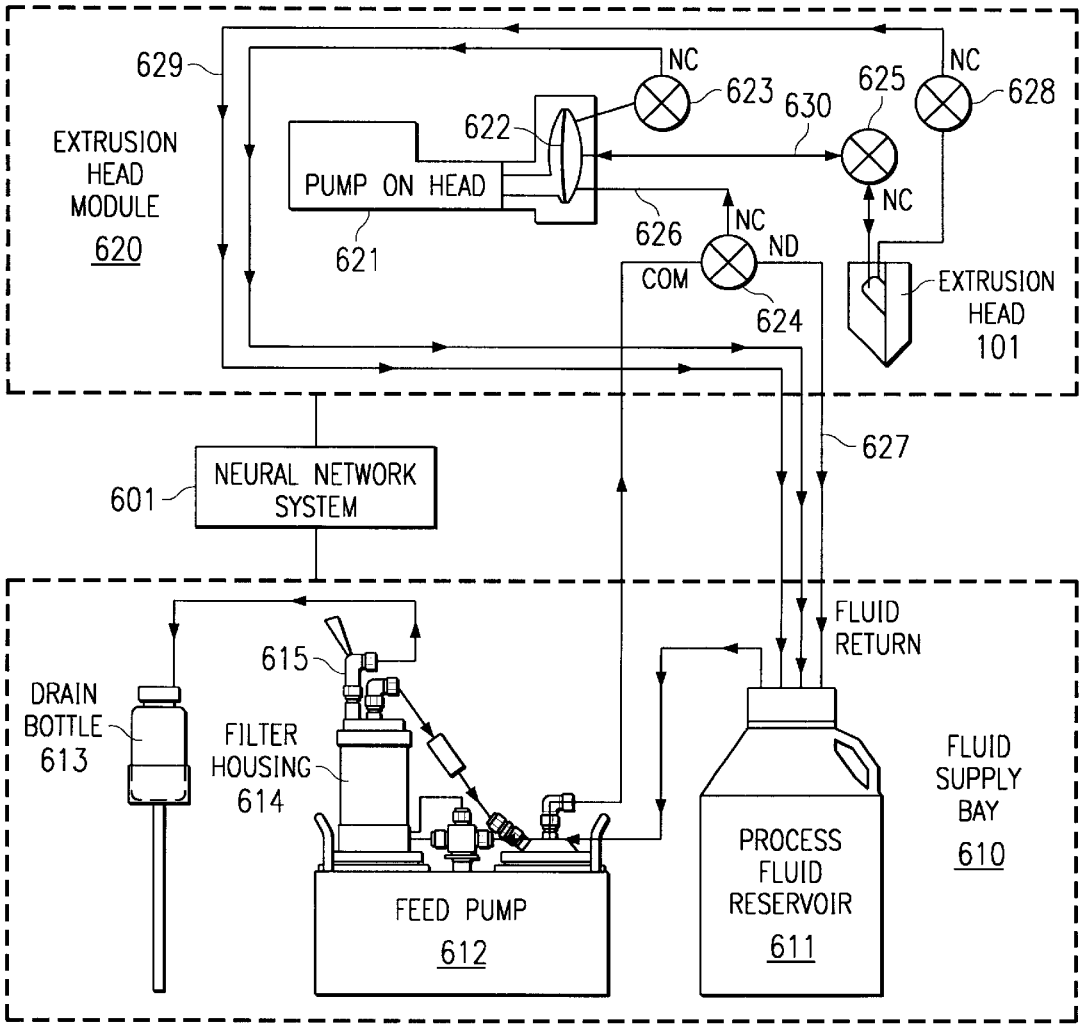
FIG. 6 depicts a plumbing diagram illustrating the flow of fluid through the extrusion mechanism.

FIG. 6 illustrates the elements and interconnections of the fluid supply bay 610 which is remotely located from the dispensing head but still within the cart, as well as the extrusion head module 620 which is integrally mounted to the dispensing head which may be an extrusion head. FIG. 6 illustrates the micro-dispenser or "pump-on-head" assembly 621, wherein a pump is directly integrated with the extrusion head for the purposes described herein. Various forms of dispensers may be used in conjunction with pump on head concept, of which the extrusion head 800 is but one example.

Process fluid for deposition on a substrate comes from fluid supply bay 610. The fluid supply bay 610 consists of a processed fluid reservoir 611, feed pump 612, and drain bottle 613. Process fluid to be deposited by the extrusion head 800 is fed from the process fluid reservoir 611 to the feed pump 612 and is then filtered within a filter housing 614. A feed pump useful in the present invention is illustrated by the pump shown in U.S. Pat. No. 5,167,837 to Snodgrass et al, entitled "FILTERING AND DISPENSING SYSTEM WITH INDEPENDENTLY ACTIVATED PUMPS IN SERIES", which is hereby incorporated by reference, although other devices may be used as well.

The filtered process fluid is then pumped by the feed pump 612 to the pump-on-head assembly 621 of the extrusion head module 620 so that the fluid may be deposited on a substrate. Excess process fluid received by the feed pump 612 is returned to the reservoir 611, with a small quantity of air and process fluid moving through vent 615.

Figure 7:
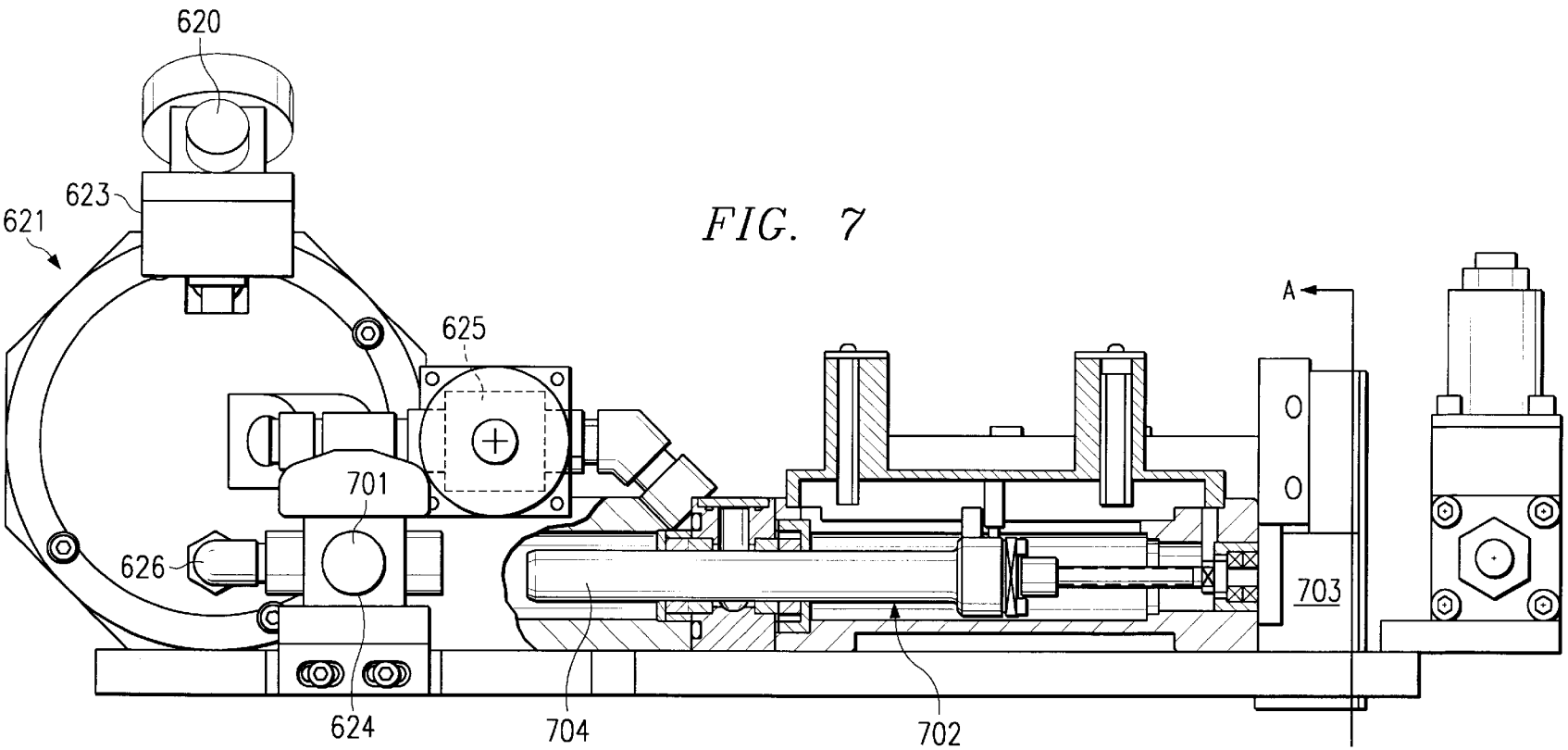
FIG. 7 depicts a partial cross-sectional view of the pump on head apparatus that is integrally connected to the extrusion head.

FIG. 7 depicts a partial cross-sectional view of the preferred embodiment pump on head apparatus that is integrally connected to the extrusion head. Fluid flow from the feed pump 612 (FIG. 6) passes through a three way recirculation valve 624 that routes the fluid flow to either the process fluid reservoir 611 (FIG. 6) in the fluid supply bay 610 (FIG. 6) through output 701 or to the micro-dispenser 621 through conduit 626. The process fluid is driven through the micro-dispenser 621 by a pump drive means 702. The pump drive means 702 comprises a drive motor (not shown) coupled through a transmission assembly 703 to a positively driven rod and seal arrangement 704. The rod and seal arrangement 704 is hydraulically coupled to an internal drive diaphragm 622 (FIG. 6) within the micro-dispenser 621. The drive motor actuates the drive rod 704 in precise and measurable movements to displace a desired amount of hydraulic fluid. The displaced hydraulic fluid drives the diaphragm 622 (FIG. 6) to displace an amount of process fluid through the micro dispenser 621 to extrusion head 800 or back to the fluid reservoir 611.

Other pumping means could include centrifugal, reciprocating, peristaltic, pressure vessel with precisely regulated pressure and/or flow controls, piston, diaphragm (single, dual, continuous or single shot, and pneumatic or hydraulically activated), gravity feed, and progressive cavity.

The direction of process fluid flow depends on whether or not the extrusion head 800 is in an active or inactive mode and the settings of an isolation valve 625 and vent valve 623. When the head is inactive, the isolation valve 625 closes and the vent valve 623 opens to direct flow of the process fluid back to the process fluid reservoir 611 of the fluid supply bay 610. During active operation, the vent valve 623 closes and the isolation valve 625 opens to direct flow of process fluid out of the micro-dispenser 621 through outlet port 629.

Referring back to FIG. 6, the neural network system, or other control system 601 preferably controls the steady-state fluid flow by monitoring the flow rate at points 626 and 630. Point 626 will measure the flow rate into the pump-on-head assembly 621. To ensure that the system has steady-state flow during the active and inactive periods, the neural network system 601 can control the openings of the recirculation valve 624, the vent valve 623 and/or isolation valve 625 to further control fluid flow. The neural network system can also control the pumping rate in a very precise manner to effect the desired flow rate changes. It is noted here that control schemes other than a neural network can be used.

The micro-dispenser or pump-on-head assembly 621 may also be configured to function as a vacuum pump to withdraw process fluid from the extrusion head and cease providing the process fluid. Otherwise stated, the pump-on-head assembly can supply negative pressure to the extrusion head. This enables an extrusion to be stopped at a more precise point on the substrate than would otherwise be possible and permits fluid flow to be stopped more instantaneously than otherwise possible. In prior art embodiments, the process fluid continued to flow until the extrusion head was emptied or until capillary action halted fluid flow from the extrusion head manifold. An extrusion head vent valve 628 may also be used to vent extraneous process fluid and/or release excess pressure from the extrusion head and limit excess flow. The vented process fluid returns to the process fluid reservoir 611 within the fluid supply bay 610 through a conduit 629. The extrusion vent valve 628 may also be controlled by the neural network to correct fluid flow anomalies that reach the extrusion head pump-on-head assembly.

Figure 8:
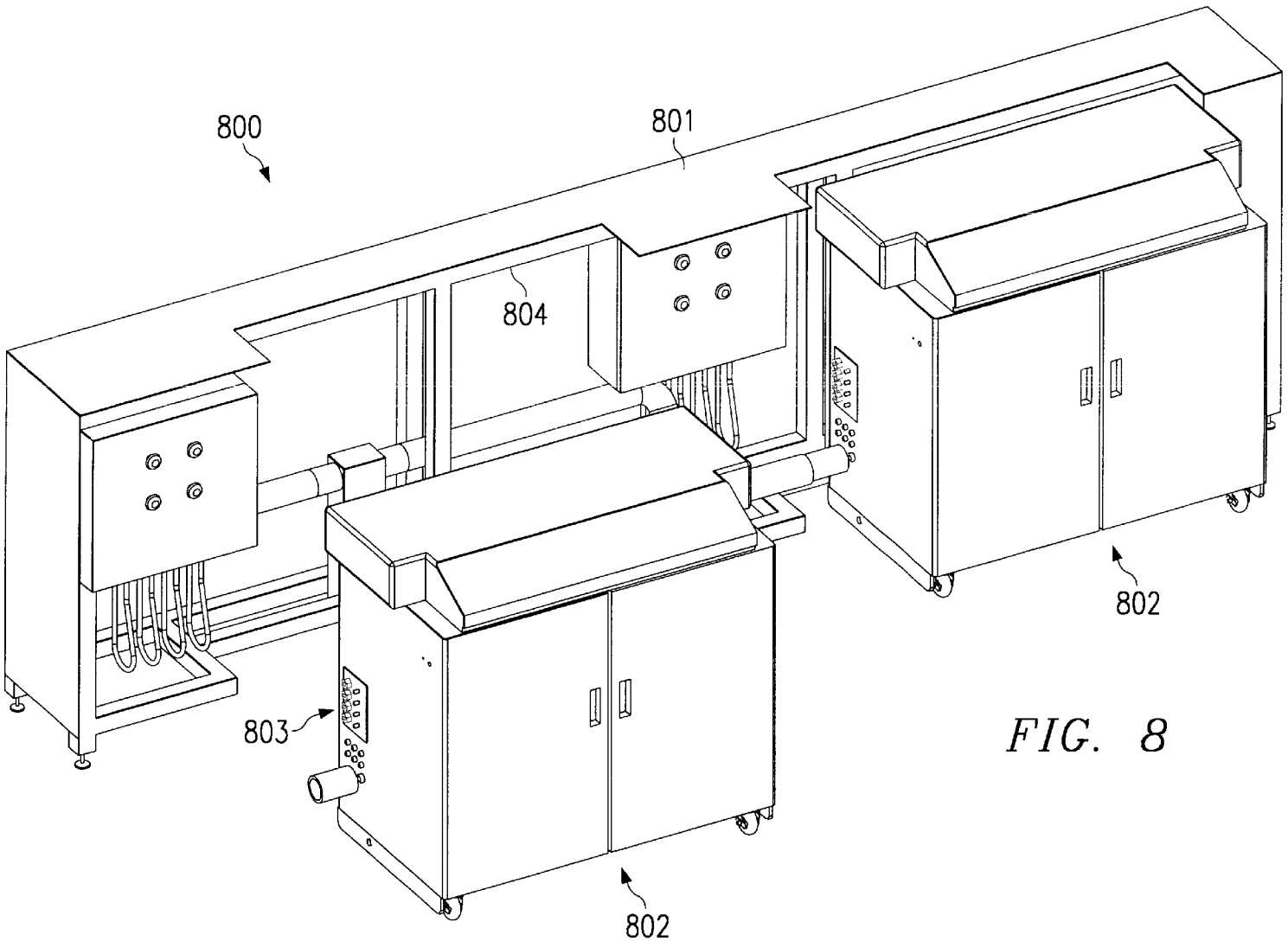
FIG. 8 depicts an isometric view of a docking station and carts attachable thereto according to a preferred embodiment of the present invention.

FIG. 8 depicts an isometric view 800 of a docking station 801 and fluid carts 802 attachable thereto according to a preferred embodiment of the present invention. FIG. 8 shows the docking station 801, with one cart 802 attached thereto, one other cart 802 not attached to the docking station, and one empty cart connection station 804 within the docking station 801. On each cart 802 are connection, or "utility connections" for power, information and facilities (including pneumatic, electrical, possibly wireless communication connections) 803.

When a fluid cart 802 is finished with a coating operation it is brought to the docking station 801 and attached to a cart connection station 804. The fluid cart 802 is both mechanically put in place, and utility connections 803 connected appropriately to the docking station 801. The utility connections permit the equipment on the fluid cart 802 to be properly powered and controlled while the cart 802 is serviced at the docking station 801. Effectively, the docking station is able to provide all the power and control to the fluid cart 802 normally provided by a base station of the coating apparatus with some extra services added.

Services available to the fluid cart 802 while stationed at the docking station 801 include cleaning of the cart 802 in general, cleaning of the surfaces which contact specialized fluids such as coating material and solvents in particular, replenishment of coating material and solvents, and removal of used solvent and coating material which is either unsuitable for a succeeding coating operation using that cart 802, or which has degraded over time or because of contamination. Accordingly, the utility connections 803 comprise means for connecting pneumatic, electrical, and hydraulic lines between the cart 802 and the docking station 801. Wireless communication can also be implemented if desired. In particular, the utility connections 803 will comprise the ability to transmit specialized fluids such as solvents for use in the cleaning and priming assembly, and coating material, both fresh and used, between the cart 802 and the docking station. Used fluids, both solvent and coating material, upon removal from the cart, may optionally be treated, either at the docking station or at another location so as to recycle the used fluids and recover fluid reusable at a future time.

In an alternative preferred embodiment of the coating apparatus, the base station will comprise all the services and connection provisions described above in connection with the docking station for servicing the fluid cart, including removal of used fluids and replenishment of solvents and coating material. It is noted that use of the docking station will generally be more efficient as it permits a base station to continue coating operations with another cart attached.

Although the present invention and its advantages have been described in detail, it should be understood that various changes, substitutions and alterations can be made herein without departing from the spirit and scope of the invention as defined by the appended claims.

What is claimed is:

1. A system for interchangeably interfacing wet components with a coating work station to provide a modular coating apparatus, the system comprising:

a work station;

a fluid cart removably attachable to the work station; and mechanical mating means disposed between said fluid cart and said work station enabling substantially rigid attachment of said fluid cart to said work station.

2. The system of claim 1, further comprising a docking station removably attachable to the fluid cart for servicing said fluid cart.

3. The system of claim 2, wherein the docking station comprises:

power for equipment on the fluid cart; and control means for controlling equipment on the fluid cart.

4. The system of claim 3 wherein the docking station further comprises:

apparatus for delivering fluid to the fluid cart; and apparatus for receiving fluid from the fluid cart.

5. The system of claim 3 wherein the docking station further comprises:

a fluid supply for delivery to the fluid cart;

at least one reservoir for storing fluid received from the fluid cart.

6. The system of claim 1, wherein the work station comprises a configuration wherein a dispensing head moves over a mostly stationary substrate.

7. The system of claim 1, wherein the work station comprises a configuration wherein a substrate supported by a chuck is moved under a mostly stationary dispensing head.

8. The system of claim 1, wherein the work station comprises apparatus for spin coating fluid onto a substrate.

9. The system of claim 1, further comprising control means for receiving information from, and controlling, equipment on the fluid cart and work station.

10. The system of claim 1, wherein the fluid cart comprises:

a fluid supply for coating operations; and fluid delivery means.

11. The system of claim 10, wherein the fluid cart further comprises a dispensing head in communication with said fluid delivery means.

12. The system of claim 11, wherein the dispensing head is removably mountable to the fluid cart and alternately to the work station.

13. The system of claim 1, wherein the work station comprises means for moving a dispensing head and a substrate to be coated with respect to each other.

14. The system of claim 12, wherein the work station comprises means for moving said dispensing head over a mostly stationary substrate.

15. The system of claim 14, wherein the means for moving is a shuttle mechanism which carries the dispenser over a mostly stationary substrate.

16. The system of claim 14, wherein the work station comprises a chuck for supporting a substrate.

17. The system of claim 14, wherein a combination of the fluid cart and the dispensing head in communication with said fluid cart comprise substantially all fluid contacting components of the coating apparatus.

18. The system of claim 12, wherein the fluid supply and fluid delivery means of said fluid cart, and said dispensing head in communication with said fluid cart are preselected for compatibility with each other.

19. The system of claim 12, wherein the fluid cart is removable from said work station without a need for disconnection of a fluid line connection.

20. The system of claim 12, wherein upon removal of a fluid cart from a work station, fluid cart components are able to receive all necessary servicing without causing idle time at any work station.

21. The system of claim 1, further comprising:

a plurality of work stations having modular cart connection means; and a plurality of fluid carts having modular work station connection means, thereby permitting any work station to be connected to any fluid cart in the network.

22. The system of claim 17, wherein the fluid cart further comprises a utility station for servicing the dispensing head.

23. The system of claim 22, wherein said utility station comprises:

means for cleaning the dispensing head; and means for priming the dispensing head.

24. The system of claim 17, further comprising means for interfacing the fluid cart to the work station.

25. The system of claim 24, wherein said means for interfacing comprises means for transmitting control information.

26. The system of claim 25, wherein said means for interfacing further comprises means for transmitting power.

27. The system of claim 25, further comprising:

means for controlling equipment disposed on the fluid cart and alternatively on the workstation; and means for receiving sensory information from the fluid cart and alternatively from the workstation.

28. The system of claim 27, wherein the means for controlling is placed apart from the work station and the fluid cart, and in communication with the work station.

29. The system of claim 27, wherein said means for controlling is located on the work station.

30. The system of claim 29, wherein the work station comprises a power source for powering equipment on the fluid cart through the means for interfacing.

31. The system of claim 30, wherein the work station further comprises:

means for delivering fluid to the fluid cart; and means for receiving fluid from the fluid cart.

32. The system of claim 31, wherein the work station further comprises:

a fluid supply for delivery of fluid to the fluid cart; and a reservoir for storing fluid received from the fluid cart.

33. The system of claim 27, further comprising:

a plurality of control means distributed among the fluid cart, the work station, and a third location in communication with the work station.

34. The system of claim 27, wherein the means for controlling comprises:

means for setting a rate at which coating material is deposited on a substrate, thereby establishing a rate of coating material deposition.

35. The system of claim 34, wherein the means for controlling comprises:

means for establishing the velocity of the means for moving the dispensing head, thereby establishing a coating velocity.

36. The system of claim 35, wherein the means for controlling comprises:

means for coordinating the rate of coating material deposition with the coating velocity.

37. The system of claim 27, wherein the means for controlling comprises:

means for receiving dispenser head gap information from a head gap sensor; and means for adjusting a head gap based on said head gap information.

38. The system of claim 37, further comprising:

means for transmitting said head gap information to said means for controlling via said means for interfacing.

39. The system of claim 27, wherein the means for controlling comprises:

means for coordinating control of a first pump located on the fluid with a second pump located on the dispensing head.

40. The system of claim 35, wherein the means for controlling comprises:

means for receiving information from sensors on the dispensing head measuring a plurality of fluid parameters, thereby generating fluid parameter measurements; and means for controlling the rate of coating material deposition and the coating velocity based on said fluid parameter measurements.

41. The system of claim 28, wherein the means for controlling comprises:

means for acquiring information from the fluid cart identifying coating fluid contained in said fluid cart.

42. The system of claim 27, wherein the fluid cart comprises means for transmitting information identifying coating fluid stored thereon and a dispensing head connected thereto.

43. A method for interchangeably interfacing wet components with other components to provide a modular coating apparatus, the method comprising the steps of:

providing a cart adapted to contain said wet components and to couple with a work station portion of said coating apparatus, thereby creating a fluid cart;

placing fluid storage and delivery equipment on the fluid cart, wherein said step of placing includes:

coupling a dispensing head to said fluid cart with fluid transmission means; and initially mounting said dispensing head on said fluid cart;

attaching the fluid cart to the work station prior to performing a coating operation; and removing said fluid cart from said work station after concluding said coating operation.

44. The method of claim 43, further comprising the steps of:

attaching the fluid cart to a docking station after said step of removing the fluid cart from the work station; and servicing the fluid cart at said docking station.

45. The method of claim 44, wherein the step of servicing comprises replenishing fluid supplies on the fluid cart.

46. The method of claim 45, wherein the step of servicing further comprises receiving fluid from the fluid cart.

47. The method of claim 44, wherein the step of servicing comprises cleaning equipment on the fluid cart.

48. The method of claim 43 further comprising the step of mounting the dispensing head on the work station prior to performing a coating operation.

49. The method of claim 48 further comprising the step of moving the dispensing head from the work station to the fluid cart upon completion of all coating operations employing said fluid cart.

50. The method of claim 48 further comprising the step of mounting the dispensing head on a linearly mobile shuttle mechanism.

51. The method of claim 48 further comprising the step of moving the dispenser and a substrate to be coated with respect to each other.

52. The method of claim 50, further comprising the step of moving the dispensing head over a substantially stationary substrate employing said shuttle mechanism.

53. The method of claim 43, further comprising the step of keeping said dispensing head on said fluid cart during said coating operation.

54. The method of claim 43, further comprising the step of interfacing the fluid cart to the work station, thereby establishing a fluid cart interface.

55. The method of claim 54, wherein the step of interfacing permits transmission of information.

56. The method of claim 54 wherein the step of interfacing permits transmission of power.

57. The method of claim 54, wherein the step of interfacing permits connection of utilities for aiding in operation of components in the coating apparatus.

58. The method of claim 43, comprising the farther step of disposing control means on the fluid cart.

59. The method of claim 54, comprising the further step of disposing control means on the work station.

60. The method of claim 59 wherein said step of interfacing enables the control means on the work station to control equipment on the fluid cart.

61. The method of claim 43 further comprising the step of disposing a power source on the fluid cart to power equipment on said fluid cart.

62. A method for providing interchangeable interfacing of wet components with additional components to comprise an apparatus useful in coating a substrate, the method comprising the steps of:

providing a movable assembly adapted to contain said wet components and to couple with a work station portion of said coating apparatus;

adapting said movable assembly for storage of at least one fluid to be manipulated by ones of said wet components thereby providing a fluid reservoir which is a portion of said wet components;

disposing fluid delivery equipment on the movable assembly in communication with said fluid reservoir, wherein said fluid delivery equipment is also a portion of said wet component;

disposing the movable assembly in juxtaposition with a portion of said additional components adapted to receive said movable assembly; and attaching the movable assembly to ones of the additional components to provide a cooperative assembly adapted to provide coating of a substrate by delivery of a fluid contained in said movable assembly and directly manipulated exclusively by said wet components of said movable assembly, wherein said step of attaching the movable assembly comprises the steps of:

removing a fluid delivery head which is at least a portion of said fluid delivery equipment from a mounting position on said movable assembly; and coupling said fluid delivery head to a mounting assembly which is a part of said additional components, wherein said mounting assembly is a shuttle mechanism adapted to provide movement of said fluid delivery head with respect to said substrate.

63. The method of claim 62 herein said step of attaching the movable assembly comprises the step of positioning on the work station, a fluid delivery head which is at least a portion of said fluid delivery equipment for delivery of a coating fluid to said substrates.

64. A method for providing interchangeable interfacing of wet components with additional components to comprise an apparatus useful in coating a substrate, the method comprising the steps of:

providing a movable assembly adapted to contain said wet components and to couple with a work station portion of said coating apparatus;

adapting said movable assembly for storage of at least one fluid to be manipulated by ones of said wet components thereby providing a fluid reservoir which is a portion of said wet components;

disposing fluid delivery equipment on the movable assembly in communication with said fluid reservoir, wherein said fluid delivery equipment is also a portion of said wet components;

disposing the movable assembly in juxtaposition with a portion of said additional components adapted to receive said movable assembly, and attaching the movable assembly to ones of the additional components to provide a cooperative assembly adapted to provide coating of a substrate by delivery of a fluid contained in said movable assembly and directly manipulated exclusively by said wet components of said movable assembly, wherein said step of attaching the movable assembly comprises the steps of:

making control signal connections between said movable assembly and said additional components; and making mechanical connections between said movable assembly and said additional components, wherein said step of attaching the movable assembly including said making of said control signal connections and said mechanical connections does not include making wet connections.

65. The method of claim 64, wherein said step of making control signal connections comprises the step of:

coupling electrical control circuits.

66. The method of claim 65, wherein said electric control circuits provide information between said movable assembly and said additional components to facilitate their cooperation in providing coating of the substrate.

67. The method of claim 66, wherein said information is identification information relevant to the movable assembly.

68. The method of claim 67, wherein said identification information identifies a particular fluid available from said movable assembly.

69. The method of claim 67, wherein said identification information identifies a particular fluid delivery head provided by said movable assembly.

70. The method of claim 67, wherein said identification information identifies said movable assembly as among a plurality of movable assemblies.

71. The method of claim 66, wherein said information is a part of a control feedback loop.

72. The method of claim 64, wherein said step of making control signal connections comprises the step of:

coupling pneumatic control circuits.

73. The method of claim 64, wherein said step of making mechanical connections comprises the step of:

securely attaching said movable assembly to said ones of said additional components.

74. The method of claim 73, wherein said step of making mechanical connections further comprises the steps of:

removing a fluid delivery head which is at least a portion of said fluid delivery equipment from a mounting position on said movable assembly; and coupling a fluid delivery head which is at least a portion of said fluid delivery equipment to a mounting assembly which is a part of said additional components;

disposing a fluid delivery conduit which provides a fluid delivery path between said fluid delivery head and said fluid reservoir so as not to interfere with coating of said substrate.

75. The method of claim 62, further comprising the step of:

disposing fluid delivery equipment servicing utilities on the movable assembly, wherein said disposition of said fluid delivery equipment servicing utilities is determined to be in juxtaposition with a fluid delivery head which is at least a portion of said fluid delivery equipment when said fluid delivery head is operable to deliver fluid to said substrate.

76. The method of claim 75, wherein said fluid delivery equipment servicing utilities include a fluid delivery head cleaning apparatus.

77. The method of claim 76, further comprising the step of:

adapting said movable assembly for storage of at least cleaning fluid in addition to said fluid to be manipulated by ones of said wet components thereby providing a cleaning reservoir which is a portion of said wet components, wherein said fluid delivery head cleaning apparatus is in communication with said cleaning reservoir.

78. The method of claim 75, wherein said fluid delivery equipment servicing utilities include a fluid delivery head priming apparatus.

79. A system for providing interconnection between modular components of a coating work station, the system comprising:

a work station for supporting a substrate during a coating operation;

a fluid cart;

interconnection means disposed between said work station and said fluid cart for assuring a substantially constant position of said fluid cart with respect to said work station during said coating operation; and wet equipment, for storage and deposition on said substrate of coating fluid for use in said coating operation, disposed on said fluid cart.

80. The system of claim 79 further comprising:

a plurality of additional fluid carts; and a plurality of additional work stations.

81. The system of claim 79 wherein said wet equipment comprises:

a dispensing head in fluid communication with said fluid storage on said fluid cart.

82. The system of claim 81 further comprising:

mounts for supporting said dispensing head disposed both on said fluid cart and on said work station.

83. The system of claim 82 further comprising:

means for transferring said dispensing head from an initial placement on said fluid cart to said supporting mounts disposed on said work station.

84. The system of claim 83 further comprising:

a transport mechanism for displacing said dispensing head with respect to said supported substrate during said coating operation.

85. The system of claim 84 wherein said transport mechanism is disposed on said work station and provides substantially linear motion of said dispensing head with respect to said supported substrate during said coating operation.

86. The system of claim 79 wherein said work station substantially excludes fluid contacting elements.

87. The system of claim 79 wherein said interconnection means comprise:

means for establishing electrical contact between said fluid cart and work station.

88. The system of claim 79 wherein said interconnection means comprise:

means for establishing at least one hydraulic connection between said fluid cart and said work station.

* * * * *